US011459070B2

(12) United States Patent
Nakatani

(10) Patent No.: US 11,459,070 B2
(45) Date of Patent: Oct. 4, 2022

(54) POSTURE CONTROL SYSTEM FOR HULL, POSTURE CONTROL METHOD FOR THE HULL, AND MARINE VESSEL

(71) Applicant: YAMAHA HATSUDOKI KABUSHIKI KAISHA, Iwata (JP)

(72) Inventor: Jun Nakatani, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 34 days.

(21) Appl. No.: 17/017,749

(22) Filed: Sep. 11, 2020

(65) Prior Publication Data

US 2021/0086875 A1 Mar. 25, 2021

(30) Foreign Application Priority Data

Sep. 24, 2019 (JP) ..... JP2019-173316

(51) Int. Cl.
*B63B 39/06* (2006.01)

(52) U.S. Cl.
CPC ..... *B63B 39/061* (2013.01)

(58) Field of Classification Search
CPC ..... B63B 39/00; B63B 39/061
See application file for complete search history.

(56) References Cited

U.S. PATENT DOCUMENTS 5,474,012 A 12/1995 Yamada et al.
7,311,058 B1 * 12/2007 Brooks ..... B63B 79/10 114/285
8,261,682 B1 * 9/2012 DeVito ..... B63B 39/061 114/285
2006/0217011 A1 9/2006 Morvillo
2017/0158297 A1 6/2017 Sampson
2018/0335788 A1 11/2018 Behling et al.

FOREIGN PATENT DOCUMENTS

JP 03-82697 A 4/1991
JP 08-40380 A 2/1996
JP 09-315384 A 12/1997
JP 2001-294197 A 10/2001
JP 2004-224103 A 8/2004
JP 2007-145162 A 6/2007
WO 2011/099931 A1 8/2011

OTHER PUBLICATIONS

Zipwake, "Operators Manual Dynamic Trim Control System", Retrieved from the Internet http://www.zipwake.com, retrieved on Jun. 3, 2020, 147 pages.
Official Communication issued in corresponding European Patent Application No. 20196190.1, dated Mar. 18, 2021.

* cited by examiner

*Primary Examiner* — Anthony D Wiest
(74) *Attorney, Agent, or Firm* — Keating and Bennett, LLP

(57) ABSTRACT

A posture control system for a hull offers a more comfortable ride to crew on a marine vessel. A posture control tab is mounted on a stern of the hull and controls the posture of the hull. An actuator actuates the posture control tab. At least one propeller generates a propulsive force for the hull. An engine turns the propeller. A controller controls the actuator according to at least one of engine torque generated by the engine and propeller torque generated by the propeller.

16 Claims, 10 Drawing Sheets

POSTURE CONTROL SYSTEM FOR HULL, POSTURE CONTROL METHOD FOR THE HULL, AND MARINE VESSEL

CROSS REFERENCE TO RELATED APPLICATIONS

This application claims the benefit of priority to Japanese Patent Application No. 2019-173316 filed on Sep. 24, 2019. The entire contents of this application are hereby incorporated herein by reference.

BACKGROUND OF THE INVENTION

1. Field of the Invention

The present invention relates to a posture control system for a hull, a posture control method for the hull, and a marine vessel.

2. Description of the Related Art

A hull of a planing boat rolls when being subjected to a reaction force (moment) against torque produced by a propeller. Particularly when the planing boat travels at low speed, lift generated at the bottom of the planing boat is small, and hence the moment generated by the propeller cannot be satisfactorily cancelled out by the lift, causing the hull to roll.

Conventionally, the planing boat has posture control tabs such as trim tabs on the port side and the starboard side of a stern so as to control the posture of the planing boat while traveling (see, for example, Japanese Laid-open Patent Publication (Kokai) No. 2001-294197 and Zipwake "Dynamic Trim-Control System" (URL: http://www.zipwake.com; hereafter referred to as Zipwake). The planing boat generates lift by lowering the posture control tabs while travelling. By lowering the posture control tab at the side that causes the hull to roll, the roll of the hull is compensated for by canceling out a moment that is generated by a propeller due to a moment arising from the generated lift. For example, according to a technique disclosed in Japanese Laid-Open Patent Publication (Kokai) No. H09-315384, the roll angle of the hull is reduced by driving actuators for stern flaps, which are a pair of right and left posture control tabs, according to a value detected by a roll angle sensor.

According to the technique disclosed in Japanese Laid-Open Patent Publication (Kokai) No. H09-315384, since the stern flaps are actuated after the roll angle sensor detects the roll angle of the hull, it is unavoidable that the hull starts to roll before the compensation, and therefore, there is room for improvement from the viewpoint of offering a more comfortable ride to crew on the planing boat.

SUMMARY OF THE INVENTION

Preferred embodiments of the present invention provide more comfortable rides to passengers on planing boats.

According to a preferred embodiment of the present invention, a posture control system for a hull includes a posture control tab mounted on a stern of the hull to control a posture of the hull; and an actuator to actuate the posture control tab. The posture control system further includes at least one propeller to generate a propulsive force to move the hull; an engine to turn the at least one propeller; and a controller configured or programmed to control the actuator according to an engine torque generated by the engine.

According to another preferred embodiment of the present invention, a posture control system for a hull includes a posture control tab mounted on a stern of the hull to control a posture of the hull; an actuator to actuate the posture control tab. The posture control system further includes at least one propeller to generate a propulsive force to move the hull; and a controller configured or programmed to control the actuator according to a propeller torque generated by the at least one propeller.

According to another preferred embodiment of the present invention, a posture control method for a hull uses a posture control system for the hull. The posture control system includes a posture control tab mounted on a stern of the hull to control a posture of the hull; an actuator to actuate the posture control tab; at least one propeller to generate a propulsive force to move the hull; an engine to turn the at least one propeller; and a controller configured or programmed to control the actuator. The method includes obtaining, by the controller, at least one of a propeller torque generated by the at least one propeller and an engine torque generated by the engine; and controlling, by the controller, the actuator according to the at least one of the propeller torque and the engine torque.

According to a preferred embodiment of the present invention, the actuator that actuates the posture control tab is controlled according to the engine torque generated by the engine and/or the propeller torque generated by the propeller. This eliminates the need to detect a roll angle of the hull when compensating for a roll of the hull, and thus it is unnecessary to wait for the hull to start to roll before compensating for the roll. As a result, more comfortable rides are provided to passengers on planing boats.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
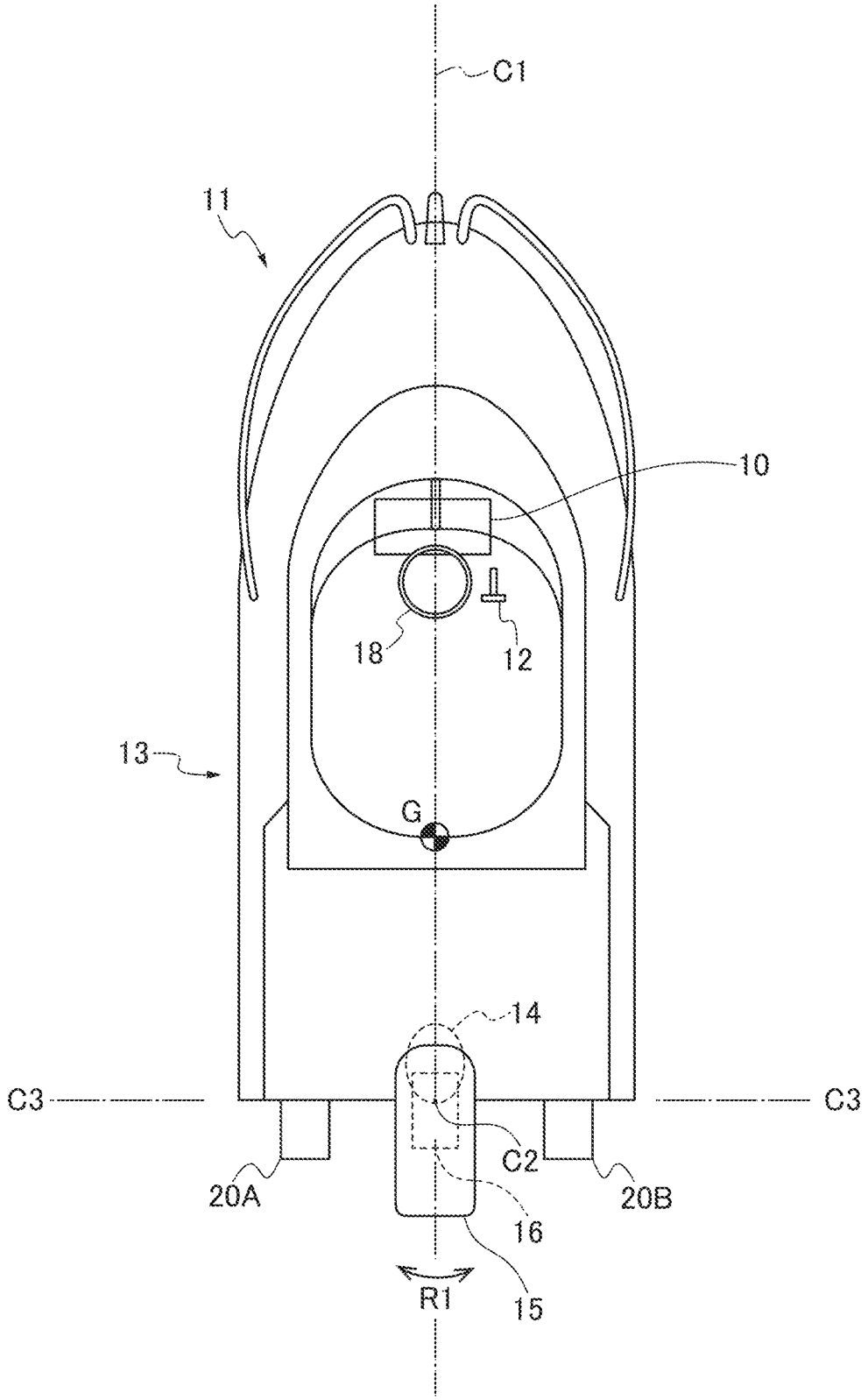
FIG. 1 is a top view of a marine vessel to which a posture control system for a hull according to a preferred embodiment of the present invention is provided.

FIG. 1 is a top view of a marine vessel to which a hull posture control system according to a preferred embodiment of the present invention is applied. A marine vessel 11 is a planing boat and includes a hull 13, preferably an odd number of (for example, one) outboard motors 15 defining and functioning as marine propulsion devices mounted on the hull 13, and a plurality of (for example, a pair of) trim tab units (trim tab units 20A and 20B in FIG. 1). A central unit 10, a steering wheel 18, and a throttle lever 12 are provided in the vicinity of a cockpit in the hull 13.

In the following description, a fore-and-aft direction, a crosswise direction, and a vertical direction refer to a fore-and-aft direction, a crosswise direction, and a vertical direction, respectively, of the hull 13. For example, as shown in FIG. 1, a centerline C1 extending in the fore-and-aft direction of the hull 13 passes through the center of gravity G of the marine vessel 11. The fore-and-aft direction is the direction along the centerline C1. Fore or front refers to the direction toward the upper side of the view along the centerline C1. Aft or rear refers to the direction toward the lower side of the view along the centerline C1. The crosswise direction is defined based on a case in which the hull 13 is viewed from the rear. The vertical direction is vertical to the fore-and-aft direction and the crosswise direction.

The outboard motor 15 is mounted on a stern of the hull 13. The outboard motor 15 is mounted on the hull 13 via a mounting unit 14. The outboard motor 15 includes an engine 16, which is, for example, an internal combustion engine, and a propeller 43 (see FIGS. 4A and 4B). The outboard motor 15 obtains a propulsive force from the propeller 43 that is turned by a driving force of the engine 15.

The mounting unit 14 includes a swivel bracket, a clamp bracket, a maneuvering shaft, and a tilt shaft (none of which are illustrated). The mounting unit 14 further includes a power trim and tilt mechanism (PTT mechanism) 23 (see FIG. 3). The PTT mechanism 23 turns the outboard motor 15 about the tilt shaft. This makes it possible to change an inclination angle (trim angle) of the outboard motor 15 with respect to the hull 13, and hence a trim adjustment to be made, and the outboard motor 15 is tilted up and down. Moreover, the outboard motor 15 is able to turn about a turning center (center of turn) C2 (about the steering shaft) with respect to the swivel bracket. Operating the steering wheel 18 causes the outboard motor 15 to turn about the turning center C2 in the crosswise direction (direction R1). Thus, the marine vessel 11 is steered.

The pair of trim tab units is mounted on the stern on the port side and the starboard side such that they are able to swing about a swing axis C3. To distinguish the two trim tab units from each other, the one located on the port side is referred to as the "trim tab unit 20A", and the one located on the starboard side is referred to as the "trim tab unit 20B".

Figure 2:
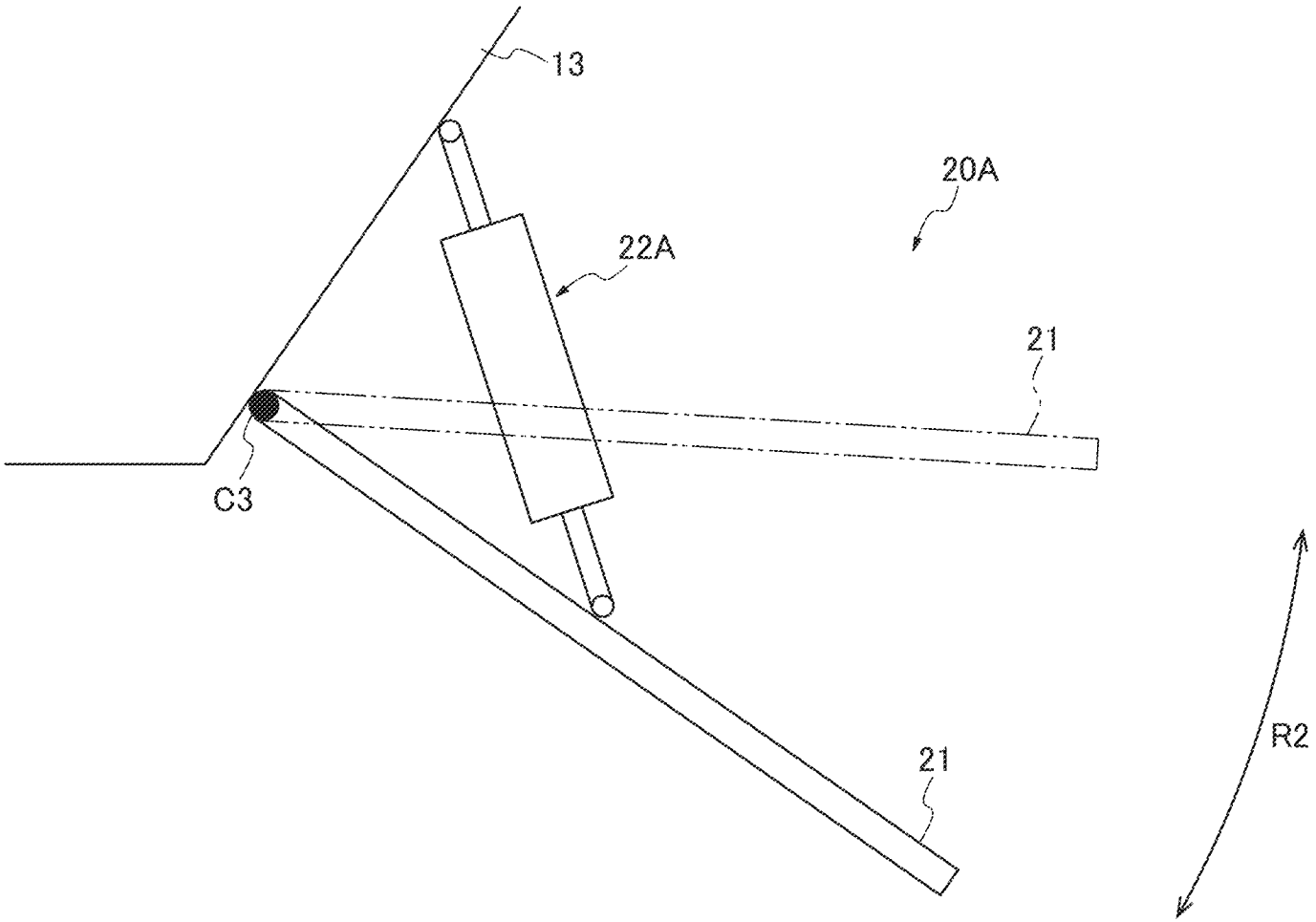
FIG. 2 is a side view of a trim tab attached to the hull.

FIG. 2 is a side view of the trim tab unit 20A attached to the hull 13. The trim tab units 20A and 20B have the same construction, and hence a construction of only the trim tab unit 20A will be described as a representative example. The trim tab unit 20A includes a trim tab actuator 22A (referred to sometimes as actuator) and a tab 21. The tab 21 is attached to the rear of the hull 13 such that it is able to swing about the swing axis C3. For example, the proximal end of the tab 21 is attached to the rear of the hull 13, and the free end of the tab 21 swings up and down (in a swinging direction R2) about the swing axis C3. The tab 21 is an example of a posture control tab that controls the posture of the hull 13.

The trim tab actuator 22A is disposed between the tab 21 and the hull 13 such that it connects the tab 21 and the hull 13 together. The trim tab actuator 22A actuates the tab 21 to swing it with respect to the hull 13. It should be noted that the tab 21 indicated by the chain double-dashed line in FIG. 2 is at a position where its free end is at the highest level, and this position corresponds to a retracted position. The tab 21 indicated by the solid line in FIG. 2 is at a position where its free end is at a lower level than a keel at the bottom of the marine vessel 11. It should be noted that a range in which the tab 21 is able to swing is not limited to the one illustrated in FIG. 2. The swinging direction R2 is defined with reference to the swing axis C3. The swing axis C3 is perpendicular or substantially perpendicular to the centerline C1 and parallel or substantially parallel to, for example, the crosswise direction. It should be noted that the swing axis C3 may extend diagonally so as cross the turning center C2.

Figure 3:
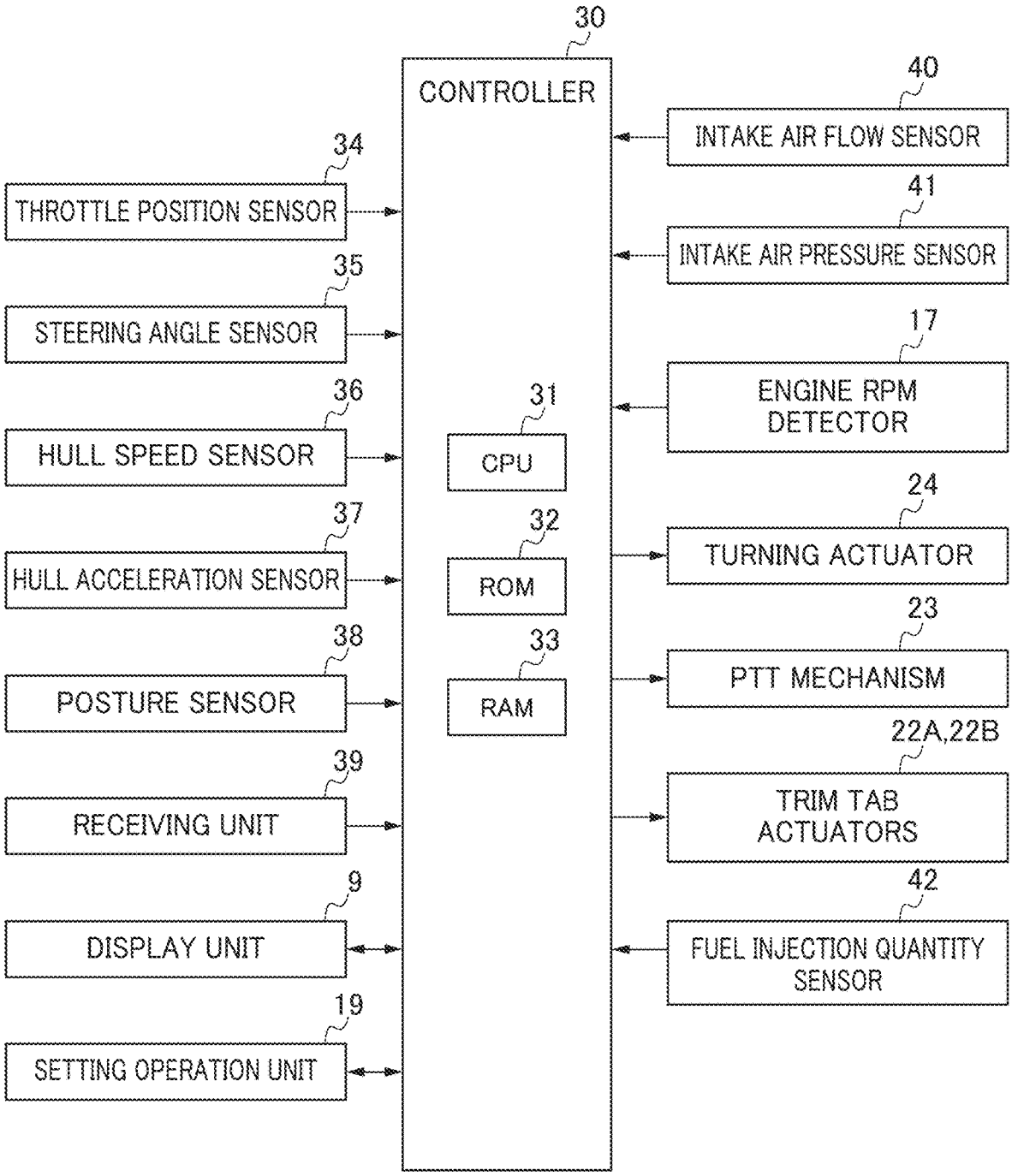
FIG. 3 is a block diagram of a maneuvering system.

FIG. 3 is a block diagram of a maneuvering system. The maneuvering system includes a posture control system for the hull according to a preferred embodiment of the present invention. The marine vessel 11 includes a controller 30, a throttle position sensor 34, a steering angle sensor 35, a hull speed sensor 36, a hull acceleration sensor 37, a posture sensor 38, a receiving unit 39, a display unit 9, and a setting operation unit 19. The marine vessel 11 also includes an engine rpm detector 17, a turning actuator 24, the PTT mechanism 23, the trim tab actuators 22A and 22B (see FIG. 2 as well), an intake air flow sensor 40, an intake air pressure sensor 41, and a fuel injection quantity sensor 42.

The controller 30, the throttle position sensor 34, the steering angle sensor 35, the hull speed sensor 36, the hull acceleration sensor 37, the posture sensor 38, the receiving unit 39, the display unit 9, and the setting operation unit 19 are included in the central unit 10 or disposed in the vicinity of the central unit 10. The turning actuator 24 and the PTT mechanism 23 are provided for the outboard motor 15 or each of the outboard motors 15 if there are multiple outboard motors. The engine rpm detector 17, the intake air flow sensor 40, the intake air pressure sensor 41, and the fuel injection quantity sensor 42 are provided in the outboard motor 15. The trim tab actuators 22A and 22B are included in the trim tab units 20A and 20B, respectively.

The controller 30 includes a CPU 31, a ROM 32, a RAM 33, and a timer which is not illustrated. The ROM 32 stores a control program. The CPU 31 loads the control program stored in the ROM 32 into the RAM 33 to implement various types of control processes. The RAM 33 provides a work area for the CPU 31 to execute the control program.

Results of detection by the sensors 34 to 38 and 40 to 42 and the engine rpm detector 17 are supplied to the controller 30. The throttle position sensor 34 detects the opening angle of a throttle valve, which is not illustrated. The steering angle sensor 35 detects the turning angle of the steering wheel 18. The hull speed sensor 36 and the hull acceleration sensor 37 detect the speed and the acceleration, respectively, of the marine vessel 11 (the hull 13) while it is traveling.

The posture sensor 38 includes, for example, a gyro sensor, a magnetic direction sensor, and so forth. Based on a signal output from the posture sensor 38, the controller 30 calculates a roll angle, a pitch angle, and a yaw angle. It should be noted that the controller 30 may calculate the roll angle and the pitch angle based on a signal output from the hull acceleration sensor 37. The receiving unit 39 includes a GNSS (Global Navigation Satellite Systems) receiver such as a GPS and includes a function of receiving GPS signals and various types of signals as positional information. Here, from a speed restricted area or ground in the vicinity, an identification signal providing notification that the area is a speed restricted area is transmitted. The speed restricted area refers to an area in a harbor or the like in which is required to limit the speed of a marine vessel to a predetermined speed or lower. The receiving unit 39 also includes a function of receiving the identification signal. It should be noted that the acceleration of the hull 13 may also be obtained from a GPS signal received by the receiving unit 39.

The engine rpm detector 17 detects the number of revolutions of the engine 16 per unit time (hereafter referred to as "the engine rpm"). The display unit 9 displays various types of information. The setting operation unit 19 includes an operator that a vessel operator uses to perform operations relating to maneuvering, a PTT operation switch, a setting operator that a vessel operator uses to make various settings, and an input operator that a vessel operator uses to input various types of instructions (none of which are illustrated).

The intake air flow sensor 40 is provided in an intake manifold or the like of the engine 16 and detects the volume of air taken in by the engine 16 when it is running (hereafter referred to as "the intake air flow"). The intake air pressure sensor 41 is also provided in an intake manifold or the like of the engine 16 and detects the pressure of air taken in by the engine 16 when it is running (hereafter referred to as "the intake air pressure"). The fuel injection quantity sensor 42 is provided in, for example, a path over which fuel is supplied to a fuel injection device (injector) and detects the quantity of fuel injected directly or indirectly toward each cylinder of the engine 16 when it is running (hereafter referred to as "the fuel injection quantity").

The turning actuator 24 turns the outboard motor 15 (or a corresponding one of outboard motors 15 if there are multiple outboard motors) about the turning center C2 with respect to the hull 13. Turning the outboard motor 15 about the turning center C2 changes the direction in which a propulsive force acts on the centerline C1 of the hull 13. The PTT mechanism 23 tilts the outboard motor 15 with respect to the clamp bracket by turning the outboard motor 15 about the tilt shaft. The PTT mechanism 23 is operated in response to, for example, operation of the PTT operation switch. As a result, the trim angle of the outboard motor 15 with respect to the hull 13 is changed.

The trim tab actuators 22A and 22B are controlled by the controller 30. For example, the trim tab actuators 22A and 22B operate in response to the controller 30 outputting control signals to them. In response to the operation of one of the trim tab actuators 22A and 22B, the corresponding tab 21 swings. It should be noted that actuators used for the PTT mechanism 23 or the trim tab actuators 22A and 22B may be either hydraulic or electric.

It should be noted that the controller 30 may obtain results of detection by the engine rpm detector 17 via a remote control ECU, which is not illustrated. The controller 30 may also use an outboard motor ECU (not illustrated) provided in the outboard motors 15 or each of the outboard motors 15 if there are multiple outboard motors, to control the corresponding engine 16.

Figure 4A:
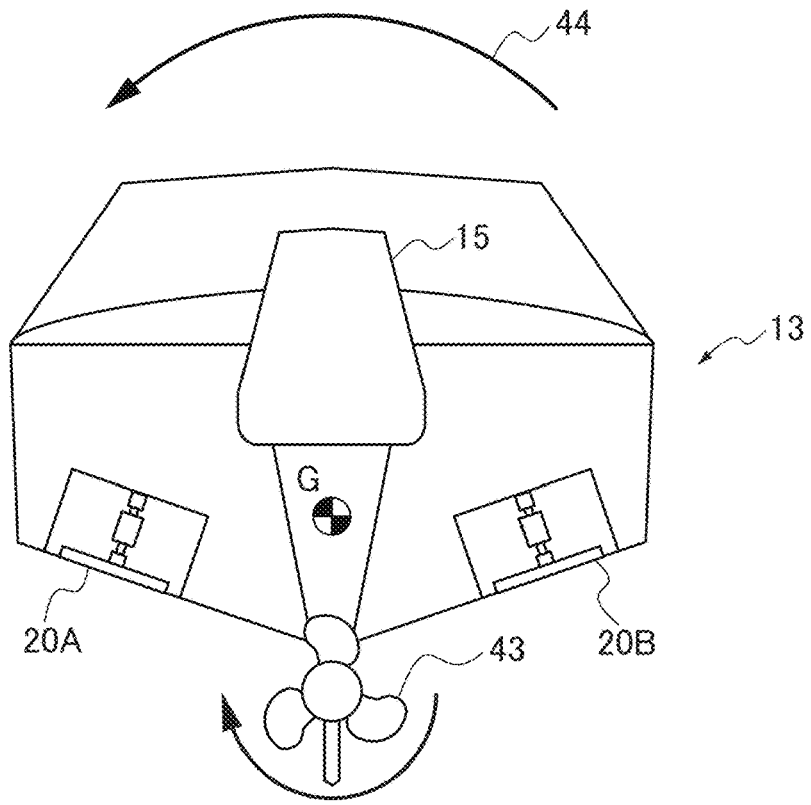
FIGS. 4A and 4B are views illustrating how the hull is caused to roll by a reaction force of torque generated by a propeller.
Figure 4B:
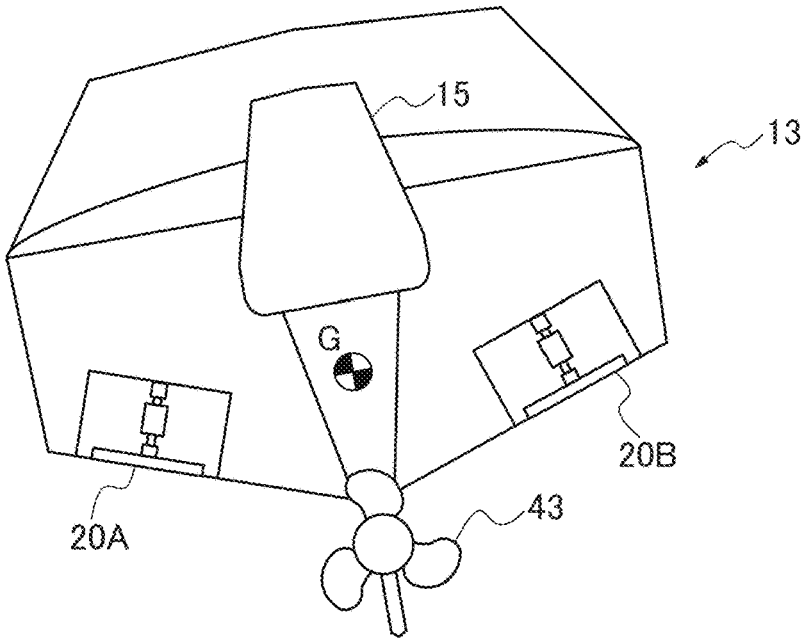

The hull 13 is subjected to a reaction force (moment) against a torque generated by the propeller 43. If the hull 13 is viewed from the rear, when, for example, the propeller 43 turns clockwise as shown in FIG. 4A, a counterclockwise propeller reaction force moment 44 acts on the hull 13. As a result, the hull 13 rolls counterclockwise as shown in FIG. 4B.

Figure 5:
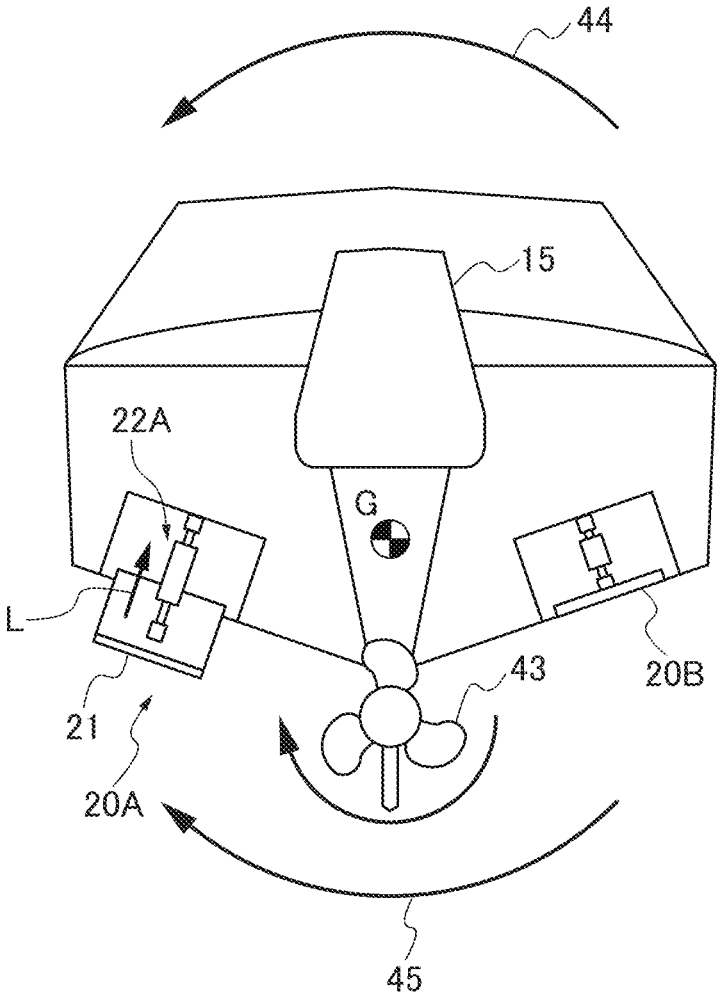
FIG. 5 is a view illustrating how the roll of the hull caused by the reaction force of torque generated by the propeller is cancelled out.

To compensate for this, as shown in FIG. 5, when the counterclockwise propeller reaction force moment 44 is generated, the trim tab actuator 22A swings down the tab 21 of the trim tab unit 20A at the port side to forcibly generate lift L. As a result, if the hull 13 is viewed from the rear, a clockwise counter moment 45 is generated, and this clockwise counter moment 45 cancels out the propeller reaction force moment 44 so as to compensate for the roll of the hull 13.

Here, in a case in which the controller 30 calculates the roll angle based on a signal output from the posture sensor 38 and then swings down the tab 21 of the trim tab unit 20A according to the calculated roll angle, it is unavoidable that the hull 13 starts to roll before compensating for the roll.

To compensate for this, in the present preferred embodiment, the controller 30 causes the trim tab actuator 22A to swing down the tab 21 without using an output from the posture sensor 38. The magnitude of the propeller reaction force moment 44 is determined by a torque (propeller torque) generated by the propeller 43, and the propeller torque is obtained by multiplying a torque (an engine torque) on a crankshaft, which is generated by the engine 16, by a gear ratio. Thus, the magnitude of the propeller reaction force moment 44 varies with the engine torque. Therefore, in the present preferred embodiment, the controller 30 causes the trim tab actuator 22A to swing down the tab 21 according to the engine torque.

Figure 6:
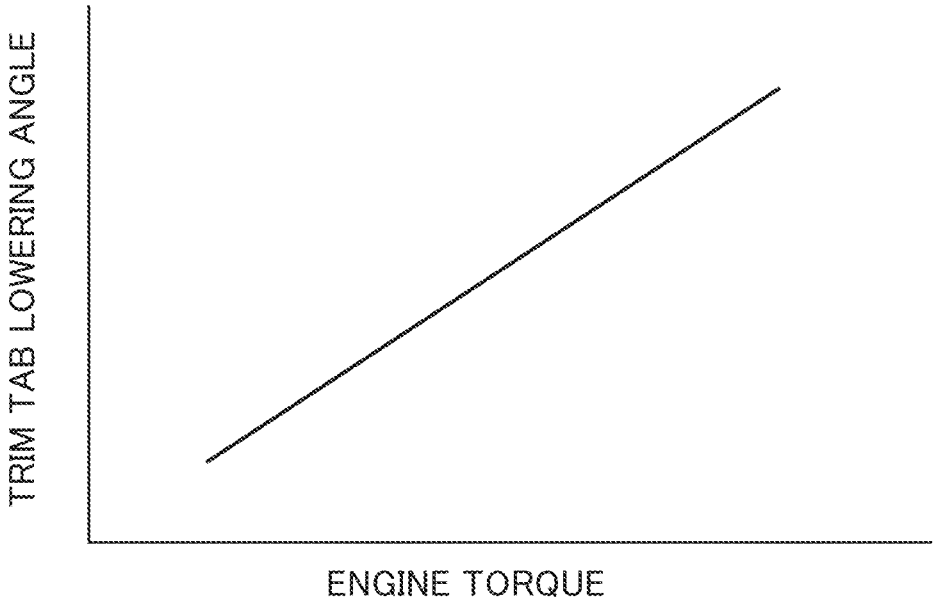
FIG. 6 is a view showing an example of a control map showing the relationship between engine torque and trim tab lowering angle, which is used by the posture control system according to a preferred embodiment of the present invention.

FIG. 6 is a view showing an example of a control map showing the relationship between engine torque and trim tab lowering angle, which is used by the hull posture control system according to the present preferred embodiment. It should be noted that in the present preferred embodiment, the angle of the tab 21, which has swung down, formed with respect to an extension of the keel will be referred to as "the trim tab lowering angle".

Since the magnitude of the propeller reaction force moment 44 varies with the engine torque described above, the counter moment 45 for canceling out the propeller reaction force moment 44 also needs to be varied with the engine torque. Specifically, since the magnitude of the propeller reaction force moment 44 increases in proportion to the engine torque, the counter moment 45 also needs to be increased in proportion to the engine torque. Moreover, the magnitude of the counter moment 45 is proportional to the magnitude of the lift L generated by the tab 21, and the magnitude of the lift L is proportional to the trim tab lowering angle. Thus, in the present preferred embodiment, the controller 30 controls the trim tab actuator 22A so that the trim tab lowering angle is increased in proportion to the engine torque.

According to the present preferred embodiment, the controller 30 controls the trim tab actuators 22A and 22B, each of which actuates the tab 21, according to the engine torque generated by the engine 16, to actuate the tab 21 so as to compensate for the roll of the hull 13. This eliminates the need to detect the roll angle of the hull 13 when compensating for the roll of the hull 13, and thus eliminates the need to wait for the hull 13 to start rolling before compensating for the roll. This offers a more comfortable ride to the crew on the marine vessel 11.

Moreover, a planing boat is caused to shift into a planing state by lift generated at the bottom of the hull 13 while traveling at high speed, and in the planing state, a moment arising from the lift generated on both of the port and starboard sides at the bottom is much greater than the propeller reaction force moment 44. For this reason, rolling of the hull 13 caused by the propeller reaction force moment 44 hardly occurs while the marine vessel 11 is traveling at high speed. However, when the marine vessel 11 is travelling at low speed, the lift generated at the bottom of the hull 13 is small, and the moment arising from the lift generated on both of the port and starboard sides at the bottom is small as well. For this reason, the propeller reaction force moment 44 effectively acts on the hull 13, causing the hull 13 to roll counterclockwise. More specifically, the lower the speed of the marine vessel 11, the more easily the hull 13 rolls due to the propeller reaction force moment 44.

Figure 7:
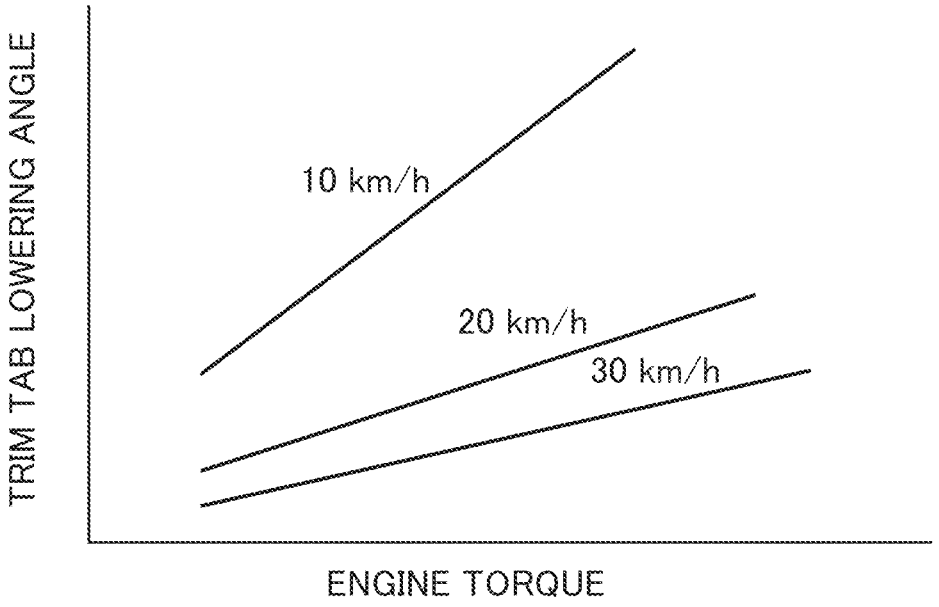
FIG. 7 is a view showing a variation of the control map showing the relationships between engine torque and trim tab lowering angle, which is used by the posture control system according to a preferred embodiment of the present invention.

To compensate for this, the trim tab lowering angle with respect to the engine torque may be varied according to the speed of the marine vessel 11. Specifically, as shown in FIG. 7, a control map showing different relationships between engine torque and trim tab lowering angle, for respective speeds of the marine vessel 11, may be used by the hull posture control system according to the present preferred embodiment. As described above, the lower the speed of the marine vessel 11, the more easily the hull 13 rolls due to the propeller reaction force moment 44, and thus, in this control map, the lower the speed of the marine vessel 11, the greater the trim tab lowering angle and the greater the counter moment 45 generated. This prevents the roll of the hull 13 from being unsatisfactorily compensated for due to the counter moment 45 being too small, or prevents the hull 13 from rolling reversely (clockwise) due to the counter moment 45 being too large. This offers a more comfortable ride to the crew on the marine vessel 11.

Figure 8:
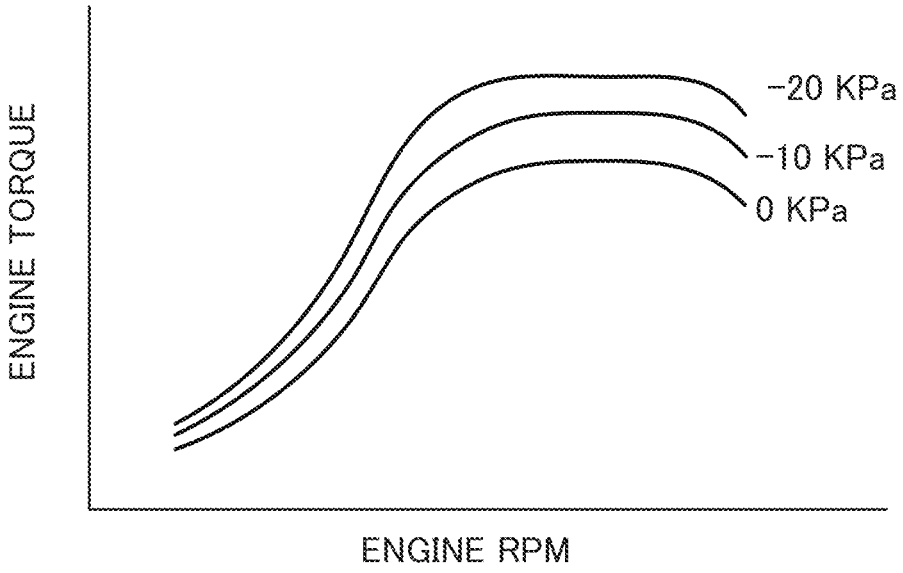
FIG. 8 is a view showing an example of an engine torque map used to calculate engine torque based on a number of revolutions and an intake air pressure of an engine.

In general, the outboard motor 15 is not equipped with a device that directly measures the engine torque, and thus in the present preferred embodiment, the engine torque is obtained by calculating it from other parameters. For example, outboard motors are required to prepare in advance an engine torque map (FIG. 8) for calculating the engine rpm and the intake air pressure. Thus, while the marine vessel 11 is traveling, the controller 30 may determine the engine torque based on the engine rpm detected by the engine rpm detector 17 and the intake air pressure detected by the intake air pressure sensor 41. In this case, based on the determined engine torque, the controller 30 determines the trim tab lowering angle with reference to the control map FIG. 6 or FIG. 7.

The intake air pressure may also be calculated from the engine rpm and the throttle opening angle. Thus, the controller 30 may calculate the intake air pressure based on the engine rpm detected by the engine rpm detector 17 and the opening angle of the throttle or the throttle opening angle detected by the throttle position sensor 34. In this case, the controller 30 determines the engine torque with reference to the engine torque map based the detected engine rpm and the calculated intake air pressure.

The engine torque may also be calculated using another engine torque map (not illustrated) based on the fuel injection quantity and the intake air flow. Thus, the controller 30 may determine the engine torque with reference to another engine torque map based on a fuel injection quantity detected by the fuel injection quantity sensor 42 and an intake air flow detected by the intake air flow sensor 40.

The intake air flow may be calculated based on an engine rpm and an intake air pressure. Thus, first, the controller 30 may determine the intake air flow based on the engine rpm detected by the engine rpm detector 17 and the intake air pressure detected by the intake air pressure sensor 41. In this case, the controller 30 determines the engine torque with reference to the engine torque map based on the fuel injection quantity detected by the fuel injection quantity sensor 42 and the calculated intake air flow.

It should be noted that the engine torque may be estimated from the total weight of the hull 13 and the outboard motor 15 and the acceleration of the marine vessel 11. Therefore, the controller 30 may obtain the engine torque by estimating it based on the acceleration of the marine vessel 11 and the total weight of the hull 13 and/or the outboard motor 15.

The controller 30 may use either one or a combination of the above described methods to determine the engine torque. If a combination of the methods is used, for example, even when one sensor fails, the method that determines the engine torque without using a result of detection by this sensor is used as an alternative, and as a result, a fail-safe function is implemented regarding compensation for the roll of the hull 13.

Figure 9A:
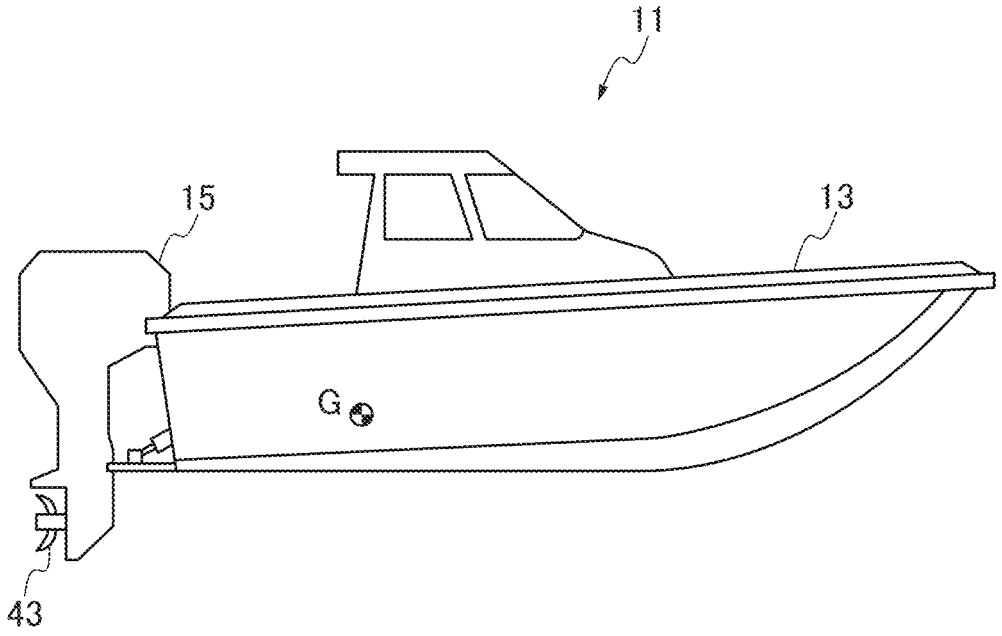
FIGS. 9A and 9B are views illustrating how the trim angle of an outboard motor changes.

In the marine vessel 11, to prevent bow-up during acceleration, the PTT mechanism 23 sometimes turns the outboard motor 15 about the tilt shaft to change the trim angle of the outboard motor 15 with respect to the hull 13. For example, in an early stage of acceleration, the trim angle of the outboard motor 15 is approximately 0° with respect to the vertical direction (FIG. 9A). On the other hand, when the bow moves up after the lapse of a certain period of time since the start of acceleration, the trim angle θ of the outboard motor 15 is set to several degrees with respect to the vertical direction so as to generate a trim moment 46 that acts in such a direction as to move the bow down (FIG. 9B).

Figure 9B:
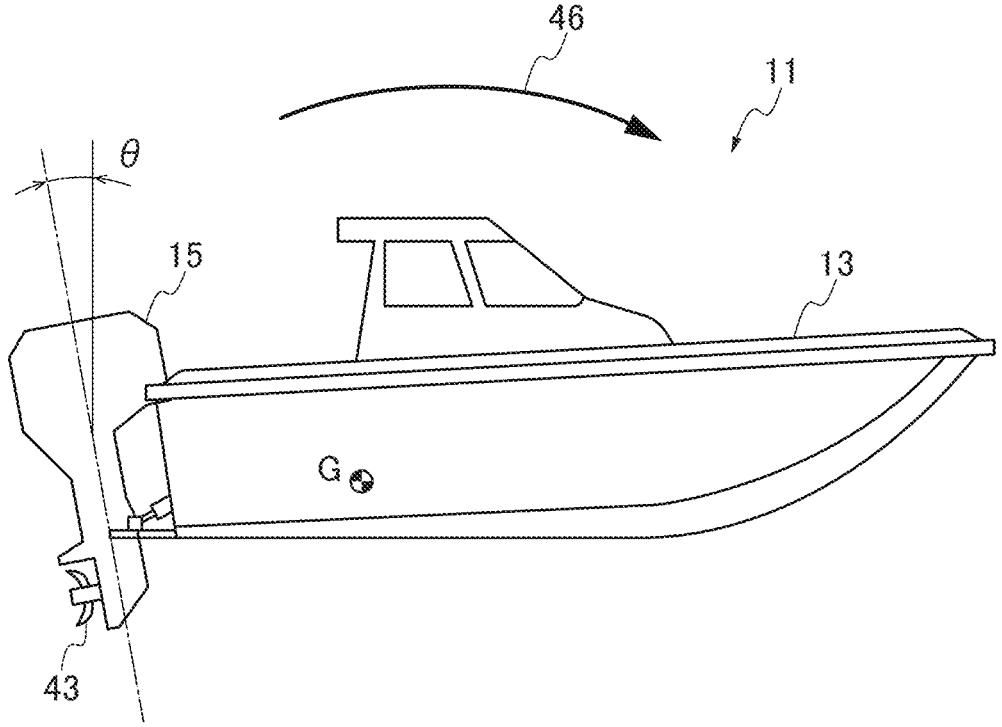

Here, when the marine vessel 11 shifts from the state in FIG. 9A to the state in FIG. 9B, the direction of the propulsive force of the propeller 43 changes, and the distance from the center of gravity G to the propeller 43 in the vertical direction changes as well. Therefore, even if the propeller 43 generates the same propeller torque, the magnitude of the propeller reaction force moment 44 changes according to the trim angle of the outboard motor 15.

Figure 10:
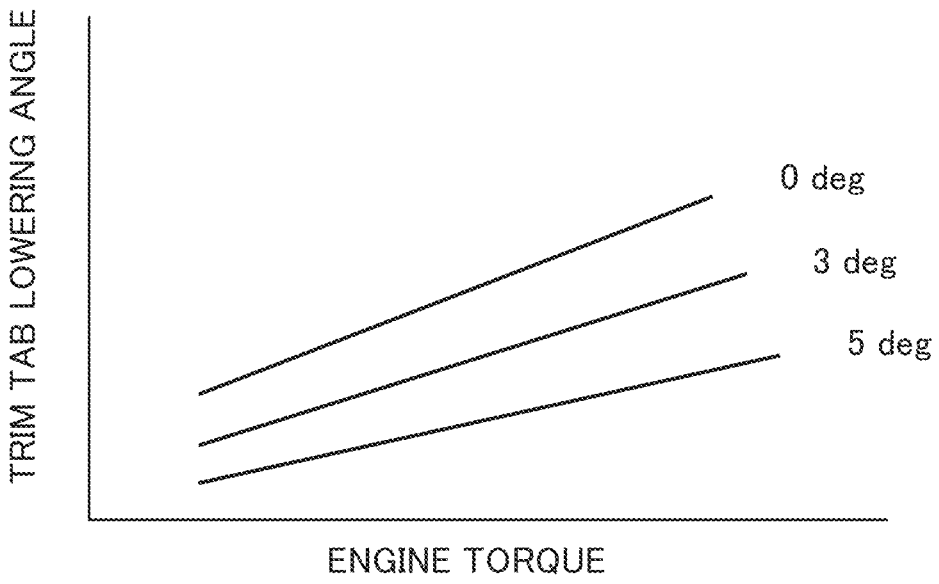
FIG. 10 is a view showing an example of a control map showing the relationships between engine torque and trim tab lowering angle in a case in which changes in the trim angle of the outboard motor are taken into consideration.

For this reason, the trim tab lowering angle with respect to the engine torque may be varied according to the trim angle θ of the outboard motor 15. Specifically, as shown in FIG. 10, a control map showing different relationships between engine torque and trim tab lowering angle, for respective trim angles θ of the outboard motor 15, may be used by the hull posture control system according to the present preferred embodiment. It is considered that the greater the trim angle θ (deg) of the outboard motor 15, the smaller the propeller reaction force moment 44. Therefore, in this control map, the greater the trim angle θ (deg) of the outboard motor 15, the smaller the trim tab lowering angle, and the smaller the counter moment 45 generated. This prevents the roll of the hull 13 from being unsatisfactorily compensated for due to the counter moment 45 being too small or prevents the hull 13 from rolling reversely (clockwise) due to the counter moment 45 being too large. As a result, a more comfortable ride is provided to the crew on the marine vessel 11.

Moreover, as described above, when the marine vessel 11 has shifted into the planing state, rolling of the hull 13 caused by the propeller reaction force moment 44 hardly occurs. Thus, controlling the trim tab lowering angle according to the engine torque as the way of controlling the posture of the hull according to the present preferred embodiment may be ended after the marine vessel 11 has shifted into the planing state. More specifically, in the present preferred embodiment, it is preferred that the trim tab lowering angle is controlled according to engine torque until the marine vessel 11 shifts into the planing state.

While preferred embodiments of the present invention have been described above, it is to be understood that the present invention is not limited to the preferred embodiments described above, but variations and modifications will be apparent to those skilled in the art without departing from the scope and spirit of the present invention.

For example, although in a preferred embodiment of the present invention, the trim tab lowering angle is controlled according to engine torque, the controller 30 may obtain propeller torque, and control the trim tab lowering angle according to the obtained propeller torque. More specifically, the controller 30 may obtain at least one of a propeller torque and an engine torque, and control the trim tab actuators 22*a* and 22*b* according to at least one of the propeller torque and engine torque obtained. In the case in which the trim tab lowering angle is controlled according to propeller torque, a control map showing the relationship between propeller torque and trim tab lowering angle, in which the trim tab lowering angle increases in proportion to the propeller torque, is prepared as a substitute for the control maps in FIGS. 7 and 8. Then, the controller 30 multiples engine torque by a gear ratio to calculate propeller torque as needed, and after that, the controller 30 controls the trim tab actuator 22*a* based on the appropriate control map.

Moreover, although in a preferred embodiment of the present invention, the marine vessel 11 has only one propeller 43, it is also likely that the propeller reaction force moment 44 is generated in a case in which the marine vessel 11 includes an odd number of propellers 43. Thus, the present invention may be applied to the marine vessel 11 when the marine vessel 11 has an odd number of propellers 43.

Furthermore, although in a preferred embodiment of the present invention, the marine vessel 11 includes the outboard motor 15, there may be a case in which, for example, the marine vessel 11 includes another type of vessel propulsive motor such as an inboard/outboard motor (a sterndrive or inboard/outboard drive) or an inboard motor. In this case, the propeller reaction force moment 44 may also be generated as above when the marine vessel 11 includes an odd number of propellers 43, and thus the present invention may be applied to this marine vessel 11.

It should be noted that an interceptor tab described in Zipwake mentioned above may be used as a substitute for the tab 21. This interceptor tab is mounted on each of both sides of the stern of the hull 13 and changes its position substantially along the vertical direction. Specifically, in the water, the interceptor tab changes its position from a position at which it projects from a bottom surface (vessel's bottom) of the hull 13 to a position which is above the bottom surface of the hull 13 and at which it is retracted. The interceptor tab changes the course of water current in a downward direction by projecting from the bottom surface of the hull 13, and hence, it generates greater lift than the lift L generated by the tab 21. As a result, the interceptor tab is able to generate the counter moment 45 as with the tab 21. Thus, in the case in which the interceptor tab is used, it is preferred that the amount to which the interceptor tab changes its position is controlled according to engine torque.

Moreover, the setting operation unit 19 may allow a vessel operator to make a setting thereon as to whether or not to execute the hull posture control method according to a preferred embodiment of the present invention (a method of controlling the trim tab units 20A and 20B with reference to the controls map in FIG. 6 or FIG. 7) at the time of activating the maneuvering system.

While the preferred embodiments of the present invention has been described above, it is to be understood that variations and modifications will be apparent to those skilled in the art without departing from the scope and spirit of the present invention. The scope of the present invention, therefore, is to be determined solely by the following claims.

What is claimed is:

1. A posture control system for a hull comprising:

a posture control tab mounted on a stern of the hull to control a posture of the hull;

an actuator to actuate the posture control tab;

at least one propeller to generate a propulsive force to move the hull;

an engine to turn the at least one propeller; and a controller configured or programmed to control the actuator according to an engine torque generated by the engine, the engine torque being calculated or estimated based on a number of revolutions of the engine and at least one of an intake air pressure of the engine, an intake air flow of the engine, a throttle opening angle of the engine, and a fuel injection quantity.

2. The hull posture control system according to claim 1, wherein the controller is configured or programmed to cause the actuator to actuate the posture control tab so as to compensate for a roll of the hull.

3. The hull posture control system according to claim 1, wherein the controller is configured or programmed to control the actuator according to a speed of the hull and the engine torque.

4. The hull posture control system according to claim 1, wherein the controller is configured or programmed to calculate or estimate the engine torque based on the number of revolutions of the engine and the intake air pressure of the engine.

5. The hull posture control system according to claim 1, wherein the controller is configured or programmed to calculate or estimate the engine torque based on the number of revolutions of the engine and the throttle opening angle of the engine.

6. The hull posture control system according to claim 1, wherein the controller is configured or programmed to calculate or estimate the engine torque based on the number of revolutions of the engine, the fuel injection quantity, and the intake air flow of the engine.

7. The hull posture control system according to claim 1, wherein the controller is configured or programmed to calculate or estimate the engine torque based on the fuel injection quantity, the number of revolutions of the engine, and the intake air pressure of the engine.

8. The hull posture control system according to claim 1, further comprising:

an outboard motor housing the engine; wherein the at least one propeller is attached to the hull; and the controller is configured or programmed to control the actuator according to an inclination angle of the outboard motor.

9. The hull posture control system according to claim 1, wherein the controller is configured or programmed to control the actuator until the hull shifts to a planing state.

10. The hull posture control system according to claim 1, wherein the at least one propeller is an odd number of propellers.

11. The hull posture control system according to claim 10, wherein the at least one propeller is one propeller.

12. A posture control system for a hull comprising:

a posture control tab mounted on a stern of the hull to control a posture of the hull;

an actuator to actuate the posture control tab;

at least one propeller to generate a propulsive force to move the hull;

an engine to turn the at least one propeller; and a controller configured or programmed to control the actuator according to an engine torque generated by the engine, the engine torque being calculated or estimated based on a weight of the hull and an acceleration of the hull.

13. A posture control system for a hull comprising:

a posture control tab mounted on a stern of the hull to control a posture of the hull;

an actuator to actuate the posture control tab;

at least one propeller to generate a propulsive force to move the hull; and a controller configured or programmed to control the actuator according to a propeller torque generated by the at least one propeller, the propeller torque being calculated or estimated based on a number of revolutions of an engine, a gear ratio, and at least one of an intake air pressure of the engine, an intake air flow of the engine, a throttle opening angle of the engine, and a fuel injection quantity.

14. A posture control method for a hull using a posture control system for the hull, the posture control system including a posture control tab mounted on a stern of the hull to control a posture of the hull, an actuator to actuate the posture control tab, at least one propeller to generate a propulsive force to move the hull, an engine to turn the at least one propeller, and a controller configured or programmed to control the actuator, the method comprising:

obtaining, by the controller, at least one of a propeller torque generated by the at least one propeller and an engine torque generated by the engine, the engine torque being calculated or estimated based on a number of revolutions of the engine and at least one of an intake air pressure of the engine, an intake air flow of the engine, a throttle opening angle of the engine, and a fuel injection quantity; and controlling, by the controller, the actuator according to the at least one of the propeller torque and the engine torque.

15. A marine vessel comprising:

a hull; and a posture control system for the hull including:

a posture control tab mounted on a stern of the hull to control a posture of the hull;

an actuator to actuate the posture control tab;

at least one propeller to generate a propulsive force to move the hull;

an engine to turn the at least one propeller; and a controller configured or programmed to control the actuator according to an engine torque generated by the engine, the engine torque being calculated or estimated based on a number of revolutions of the engine and at least one of an intake air pressure of the engine, an intake air flow of the engine, a throttle opening angle of the engine, and a fuel injection quantity.

16. A marine vessel comprising:

a hull; and a posture control system for the hull including:

a posture control tab mounted on a stern of the hull to control a posture of the hull;

an actuator to actuate the posture control tab;

at least one propeller to generate a propulsive force to move the hull; and a controller configured or programmed to control the actuator according to a propeller torque generated by the at least one propeller, the propeller torque being calculated or estimated based on a number of revolutions of an engine, a gear ratio, and at least one of an intake air pressure of the engine, an intake air flow of the engine, a throttle opening angle of the engine, and a fuel injection quantity.

* * * * *